US012194347B2

(12) United States Patent
Hardin, III

(10) Patent No.: US 12,194,347 B2
(45) Date of Patent: Jan. 14, 2025

(54) BALL COLLECTION APPARATUS

(71) Applicant: James Gerald Hardin, III, Fitzgerald, GA (US)

(72) Inventor: James Gerald Hardin, III, Fitzgerald, GA (US)

( * ) Notice: Subject to any disclaimer, the term of this patent is extended or adjusted under 35 U.S.C. 154(b) by 842 days.

(21) Appl. No.: 17/381,379

(22) Filed: Jul. 21, 2021

(65) Prior Publication Data

US 2022/0040538 A1 Feb. 10, 2022

Related U.S. Application Data

(60) Provisional application No. 63/061,260, filed on Aug. 5, 2020.

(51) Int. Cl.
*A63B 47/02* (2006.01)
*A63B 71/02* (2006.01)

(52) U.S. Cl.
CPC ..... *A63B 47/025* (2013.01); *A63B 71/022* (2013.01); *A63B 2209/08* (2013.01); *A63B 2209/10* (2013.01)

(58) Field of Classification Search
CPC . A63B 47/025; A63B 71/022; A63B 2209/08; A63B 2209/10
USPC ..... 294/19.2; 473/197
See application file for complete search history.

(56) References Cited

U.S. PATENT DOCUMENTS

| | | | | |
|---|---|---|---|---|
| 2,195,634 | A * | 4/1940 | Shelley, Jr. | A63B 57/357 473/196 |
| 3,918,711 | A * | 11/1975 | Zak | A63B 69/38 473/197 |
| 4,750,744 | A * | 6/1988 | Michalec | A63B 63/00 473/197 |
| 4,883,272 | A | 11/1989 | Lay | |
| 6,299,554 | B1 | 10/2001 | Sinclair et al. | |
| 6,315,677 | B1 | 11/2001 | Sandlin | |
| 7,056,241 | B1 * | 6/2006 | Ishino | A63B 69/0095 473/473 |
| 9,199,149 | B2 * | 12/2015 | Max | A63B 63/08 |
| 9,271,552 | B2 | 3/2016 | Van Ostenbridge | |
| 10,232,228 | B2 * | 3/2019 | Eaglin | A63B 69/0002 |

* cited by examiner

*Primary Examiner* — Paul T Chin
(74) *Attorney, Agent, or Firm* — Thompson Hine LLP

(57) ABSTRACT

Ball collection apparatus and methods for forming ball collection apparatus are disclosed. In one aspect, a ball collection apparatus includes a netting body that includes netting, edges around a perimeter of the netting, and corners along the perimeter of the netting at intersections of the edges, the edges including a front edge, a back edge, a first side edge, and a second side edge, a plurality of connectors attached to the netting body at the corners of the netting body, a plurality of fasteners attached to the netting body, and a guiding device operably coupled to the netting proximate an aperture defined by the netting, the guiding device having a weight to produce a slope in the netting sufficient to guide a sport ball to exit the netting body via the aperture.

16 Claims, 6 Drawing Sheets

BALL COLLECTION APPARATUS

CROSS-REFERENCE TO RELATED APPLICATION

This patent application claims the benefit of U.S. Provisional Application No. 63/061,260 filed on Aug. 5, 2020, entitled "BALL COLLECTION APPARATUS," which is incorporated herein by this reference in its entirety.

TECHNICAL FIELD

This specification generally relates to an apparatus or devices for collecting balls in a sports cage.

BACKGROUND

There inherently is an inefficiency of gathering balls in a sports cage during or after a practice (e.g., hitting baseballs in a batting cage). Typically, a person (e.g., a player or instructor) has to spend several minutes gathering balls at the end of a sports training session (e.g., hitting balls in a sports cage) because they are spread out throughout the cage. This requires the person to bend over frequently to pick up balls on the ground. The collection of balls must be repeated each time the supply of balls runs out.

SUMMARY

This specification describes an apparatus for collecting balls in a batting cage. This specification further describes a method of manufacturing an apparatus for collecting balls in a batting cage.

In general, one innovative aspect of the subject matter described in this specification can be embodied in a ball collection apparatus for collecting balls in a sports cage, the ball collection apparatus may include a netting body that includes netting, edges around a perimeter of the netting, and corners along the perimeter of the netting at intersections of the edges, the edges including a front edge, a back edge, a first side edge, and a second side edge, a plurality of connectors attached to the netting body at the corners of the netting body, a plurality of fasteners attached to the netting body, wherein the fasteners are positioned between the corners along the back edge, the first side edge, and the second side edge of the netting body, and a guiding device operably coupled to the netting proximate an aperture defined by the netting, the guiding device having a weight to produce a slope in the netting sufficient to guide a sport ball to exit the netting body via the aperture.

These and other aspects can each optionally include one or more of the following features In some aspects, when the ball collection apparatus is connected to a sports cage via the plurality of connectors, the fasteners are attachable to the sports cage to reduce gaps between the netting body and the sports cage. In some aspects, each of the fasteners includes a hook-and-loop fastener. In some aspects, the fasteners are equally-spaced along the back edge, the first side edge, and the second side edge of the netting body.

In some aspects, each of the connectors are configured to removably connect the main netting body to wire portions of chain-link fencing. In some aspects, each of the connectors includes a D-ring clip. In some aspects, each of the connectors includes magnets. In some aspects, each of the connectors includes a hook-and-loop fastener. In some aspects, each of the connectors includes at least a portion of a snap connector. In some aspects, each of the connectors includes an adhesive.

In some aspects, the netting includes a fiber net mesh.

In some aspects, the ball collection apparatus further includes a ground ball apparatus that includes a plurality of fasteners at an edge of the ground ball apparatus, and the fasteners connecting a top edge of the ground ball apparatus with the front edge of the netting body. In some aspects, the ground ball apparatus further includes connectors located at top corners of the ground ball apparatus. In some aspects, the ground ball apparatus includes a netting.

In general, one innovative aspect of the subject matter described in this specification can be embodied in a method of forming a ball collection apparatus that include the actions of forming a main netting body that includes a middle portion, a front edge, a back edge, a first side edge, and a second side edge, connecting a plurality of main connectors to corners of the main netting body, wherein the main connectors are configured to allow a user to connect the main netting body to a batting cage apparatus, connecting a plurality of fasteners to the back edge, to the first side edge, and to the second side edge of the main netting body, wherein the fasteners are adjustable and configured to allow a user to adjust the main netting body about a batting cage apparatus to reduce gaps between the main netting body and the batting cage when connected, and connecting a guiding device to the middle portion of the main netting body, the guiding device configured to allow a sports ball to exit at the middle portion of the main netting body.

These and other aspects can each optionally include one or more of the following features.

In some aspects, the method further includes connecting a ground ball net to a first side of the main body of the ball collection apparatus using a plurality of connectors.

Particular embodiments of the subject matter described in this specification can be implemented so as to realize one or more of the following advantages. The ball collection apparatus allows a user to quickly gather balls after a hitting session (e.g., baseball, softball, etc.). The ability to quickly gather the balls can improve a user's performance of these tasks (e.g., more hitting per session with less time to gather balls at the end). The ability to quickly gather the balls also allows a hitting instructor more time to spend with clients rather than waiting on the client to gather the balls at the end of a teaching session, and/or the hitting instructor to have to help gather balls as well. The apparatus can be connected to any existing batting cage without the need to redesign the cage because of the latching elements that attaches the apparatus to the cage. Additionally, the ball collection apparatus is provided with connectors and fasteners that allow the user to quickly attach and unattach the netting to adjust the connections points of the ball collection apparatus to a sports cage and adjust the spacing between the ball collection apparatus and the netting of the sports cage to prevent sports falls from falling through the gaps.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

So that the present disclosure can be understood by those of ordinary skill in the art, a more detailed description may be had by reference to aspects of some illustrative implementations, some of which are shown in the accompanying drawings.

Many aspects of the subject matter described herein can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

Figure 1:
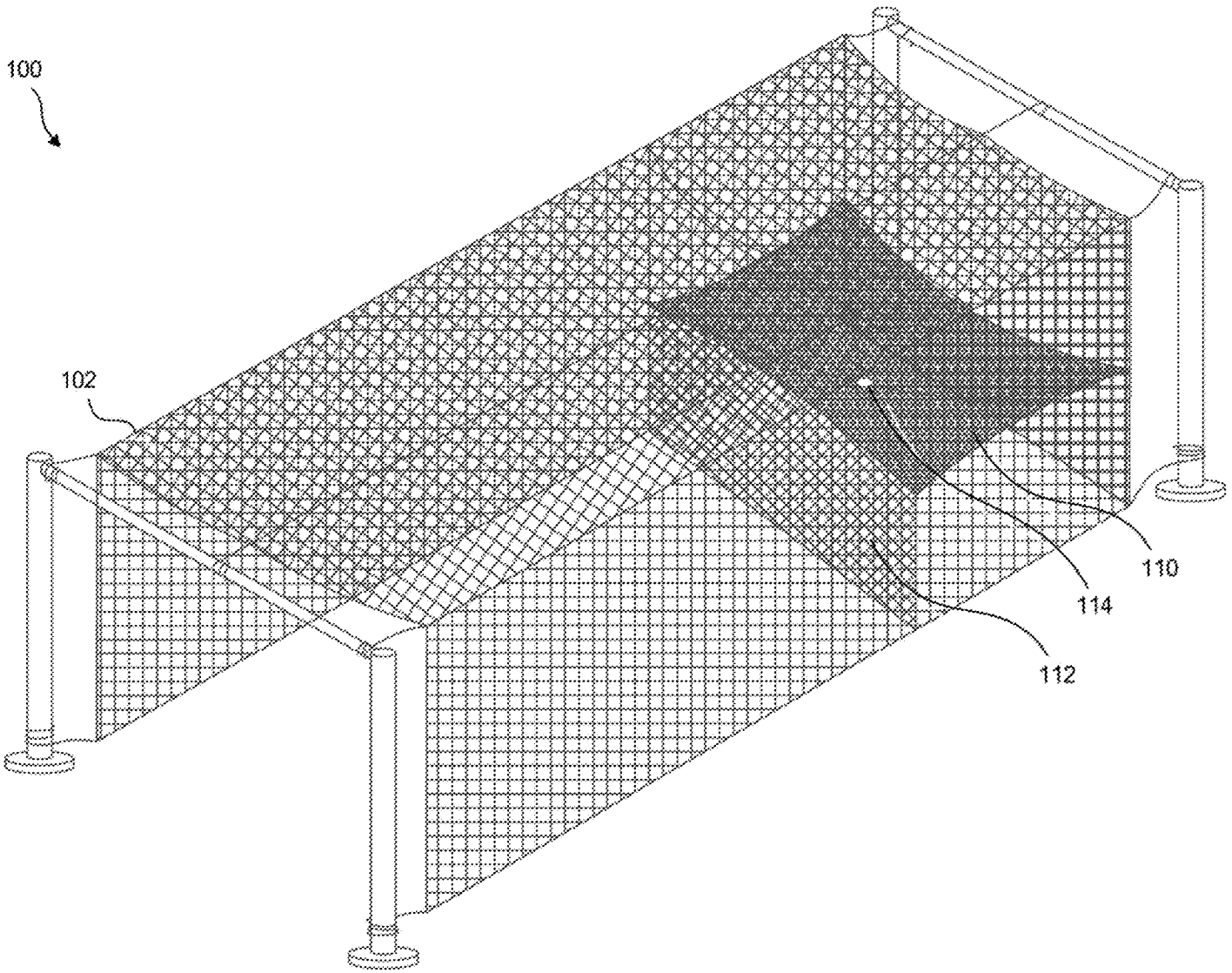
FIG. 1 is a drawing of an example ball collection apparatus in a sports cage.

In accordance with common practice the various features illustrated in the drawings may not be drawn to scale. Accordingly, the dimensions of the various features may be arbitrarily expanded or reduced for clarity. In addition, some of the drawings may not depict all of the components of a given system, method or device. Finally, like reference numerals may be used to denote like features throughout the specification and figures.

DETAILED DESCRIPTION

This document describes a ball collection apparatus that collects balls used in a sports cage during sport training activities such as baseball, softball, golf, etc. The ball collection apparatus described herein achieves the goals of providing a user (e.g., a ball player, an instructor, etc.) to quickly gather balls after a sports cage activity session (e.g., baseball, softball, golf, etc.). The ability to quickly gather the balls can improve a user's performance of these tasks (e.g., more hitting per session with less time to gather balls at the end). The ability to quickly gather the balls also allows an instructor more time to spend with clients rather than waiting on the client to gather the balls at the end of a teaching session, and/or the instructor to have to help gather balls as well. The apparatus can be connected to any existing sports cage without the need to redesign the cage because of the latching elements that attaches the apparatus to the cage. Thus, the ball collection apparatus discussed herein provides advantages over prior ball collection devices, as described in more detail below.

Numerous details are described in order to provide a thorough understanding of the example implementations shown in the drawings. However, the drawings merely show some example aspects of the present disclosure and are therefore not to be considered limiting. Those of ordinary skill in the art will appreciate that other effective aspects and/or variants do not include all of the specific details described herein. Moreover, well-known systems, methods, components, devices and circuits have not been described in exhaustive detail so as not to obscure more pertinent aspects of the example implementations described herein.

Figure 2:
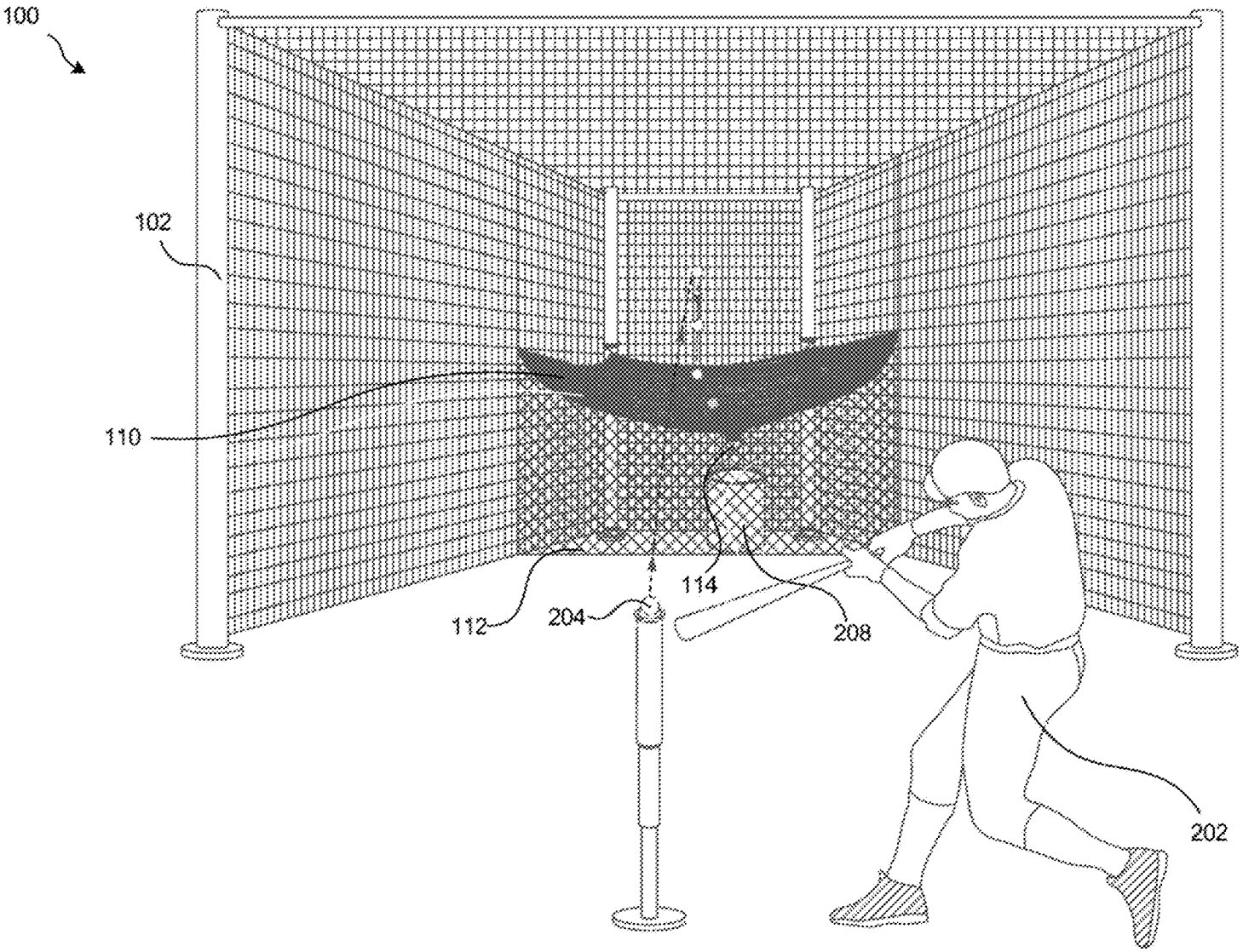
FIG. 2 is a drawing of an example ball collection apparatus in the sports cage of FIG. 1 from a different perspective.

FIGS. 1 and 2 illustrate an example environment 100 of a sports cage 102. In particular, FIG. 1 represents an aerial perspective view of the sports cage 102 (e.g., a bird's eye view), and FIG. 2 represents a front perspective view of the sports cage 102 (e.g., looking through the entrance of the cage behind a user 202 during a hitting session).

The sports cage 102 can be used for any type of sport that can be trained using a ball and that may require multiple repetitions in a cage for training. For example, the sports cage 102 as shown represents a batting cage for baseball or softball. However, the sports cage 102 could also be used for hitting golf balls, tennis balls, cricket balls, etc. Thus, although the drawings and the embodiments described herein are described for a batting cage for baseball and/or softball, the sports cage 102 is not intended to represent any particular sport, but instead, the embodiments are intended to represent a sport that may require a cage for multiple repetitions.

The sports cage 102 includes a ball collection apparatus 110 at an end of the sports cage 102. In some embodiments, the ball collection apparatus 110 may include a netting body that includes netting, edges around a perimeter of the netting, and corners along the perimeter of the netting at intersections of the edges. The edges can include a front edge, a back edge, a first side edge, and a second side edge. In some implementations, the netting can include a fiber net mesh. Alternatively, the netting can include any type of netting that is space sufficiently that standard sport ball would not fall through the openings of the netting. For example, a golf ball sports cage may require smaller holes in the netting than a hitting cage for a baseball and/or softball (e.g., a golf ball is approximately 42 mm in diameter, and a baseball is approximately 75 mm in diameter). Thus the holes in the netting need to be smaller than the size of the sports ball being used.

In some embodiments, the ball collection apparatus 110 may further include a plurality of connectors attached to the netting body at the corners of the netting body, and a plurality of fasteners attached to the netting body. In the exemplary implementation as shown, the fasteners are positioned between the corners along the back edge, the first side edge, and the second side edge of the netting body. In some embodiments, the fasteners are configured to be attachable to the sports cage to reduce gaps between the netting body and the sports cage. For example, the fasteners allow a user to adjust and move the fasteners accordingly to reduce gaps so a ball cannot fit between the sports cage 102 and the ball collection apparatus 110. In some embodiments, additional fasteners and/or connectors can be added by the user to reduce gaps or provide additional connection points with the sports cage 102. In some embodiments, the fasteners are equally-spaced along the back edge, the first side edge, and the second side edge of the netting body. The connectors and fasteners are further described herein with reference to FIGS. 3 and 4.

As shown in FIGS. 1 and 2, the ball collection apparatus 110 is placed at approximately half of the height of the inside of the sports cage 102 and is connected to three sides of the sports cage 102. Alternatively, the ball collection apparatus 110 may be adjusted to different heights depending on the sport or by the preference of the user. For example, for a taller sports cage, the ball collection apparatus 110 may be adjusted lower to collect more balls, as the ball collection apparatus 110 will only collect balls that land into and above the netting body.

In some embodiments, the sports cage 102 includes a ground ball apparatus 112 that is connected to two sides of the sports 102 and to the ball collection apparatus 110. For example, the ground ball apparatus 112 includes a plurality of fasteners at an edge of the ground ball apparatus that can connect a top edge of the ground ball apparatus with the front edge of the netting body of the ball collection apparatus 110. The ground ball apparatus 112 is further described herein with reference to FIG. 5.

During installation of the ball collection apparatus 110 in the sports cage 102, a user can make adjustments to remove any possible gaps between the ball collection apparatus 110 and the walls (e.g., mesh netting) of the sports cage 102. For example, he or she could tighten a fastener to bring the ball collection apparatus 110 closer to the wall of the sports cage 102. Additionally, or alternatively, he or she could release a fastener from one fence ring and attach to a laterally adjacent ring or a ring above. Additionally, or alternatively, he or she could pull a fastener through a ring and the attach to a lower ring to pull the netting tighter.

The ball collection apparatus 110 may further include a guiding device 114 that is operably coupled to the netting proximate an aperture defined by the netting. In the exemplary implementation, the guiding device can include a weight to produce a slope in the netting sufficient to guide a sport ball to exit the netting body via the aperture. The guiding device 114 is further described herein with reference to FIG. 6.

During use of the ball collection apparatus 110 in the sports cage 102, as shown in FIG. 2, a sports player 202 hits a ball 204 that travels with a projection towards the back end of the sports cage 102 and above the placement of the ball collection apparatus 110 (e.g., a baseball hit to the back of the batting cage). As the ball hits the netting in the back of the sports cage 102, the ball 204 falls into the netting body of the ball collection apparatus 110. Due to gravity and the weight of the guiding device 114 creating a downward slope in the netting body towards the aperture of the guiding device 114 in the middle of the netting body, the ball will roll towards and into the aperture of guiding device 114 and into a sports compartment 208 (e.g., a bucket) for collecting the sports balls (e.g., ball 204). The ground ball apparatus 112, an optional component, can be used to help prevent balls hit below the ball collection apparatus 110 which would be more difficult to gather for a user reaching below the netting of the ball collection apparatus 110.

Figure 3:
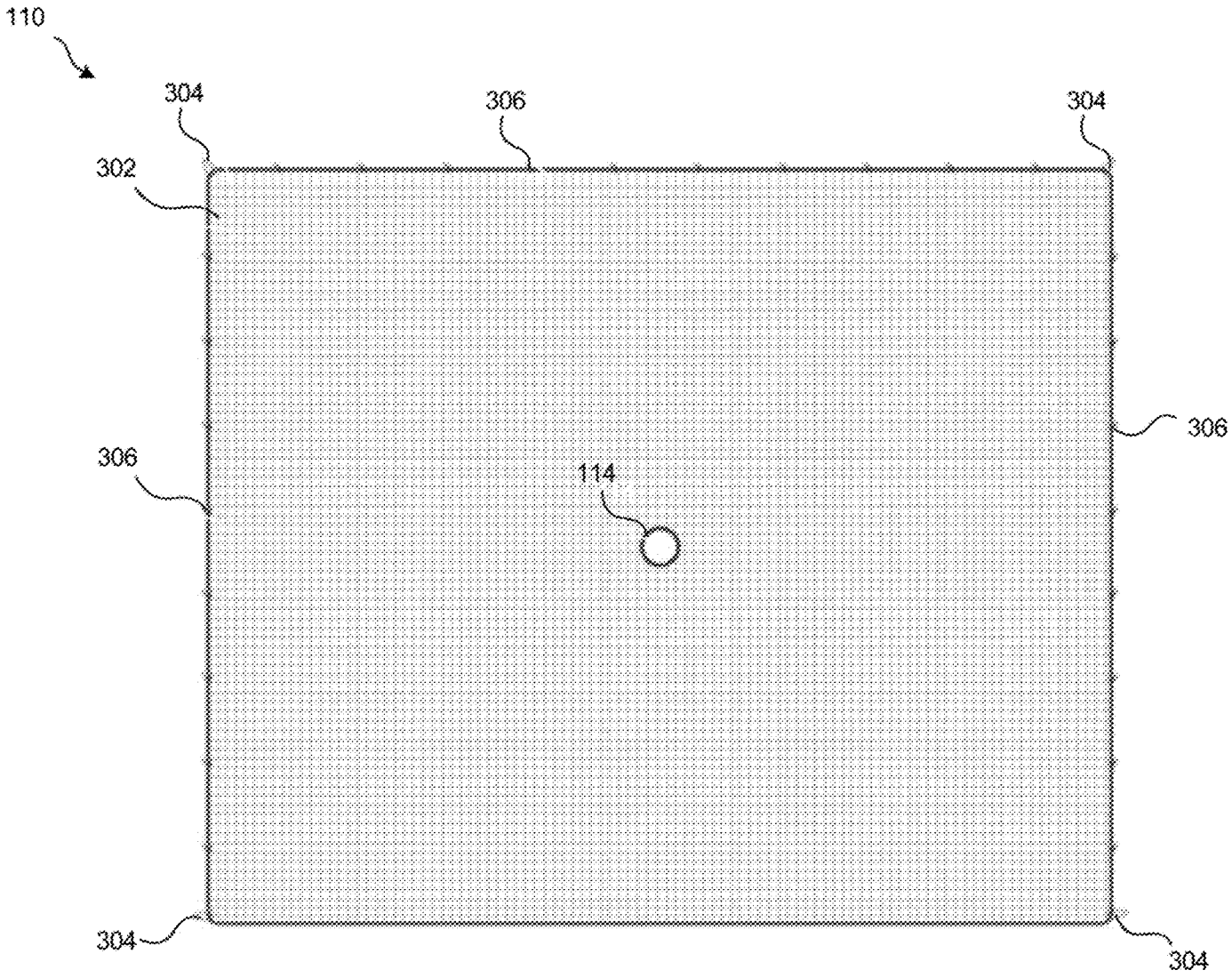
FIG. 3 is a drawing of a top view of an example ball collection apparatus.
Figure 4:
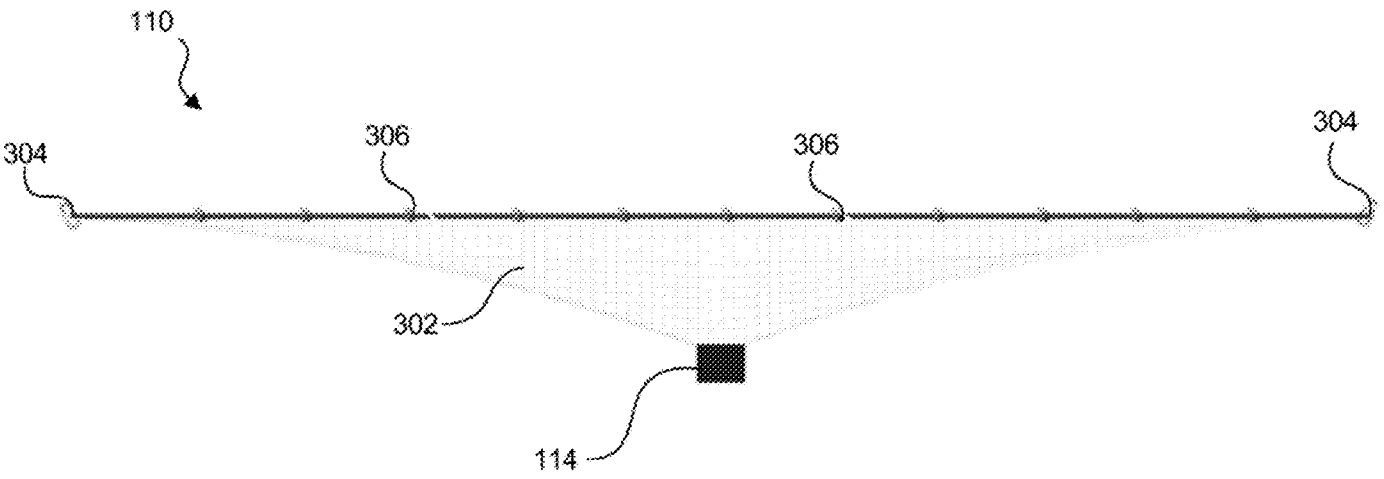
FIG. 4 is a drawing of a side view of an example ball collection apparatus.

FIG. 3 is a drawing of a top view of the ball collection apparatus 110, and FIG. 4 is a drawing of a side view of the ball collection apparatus 110. In an exemplary embodiment, as shown in FIGS. 3 and 4, the ball collection apparatus 110 includes a netting body 302 that includes netting (e.g., a fiber net mesh or the like), edges around a perimeter of the netting, and corners along the perimeter of the netting at intersections of the edges. The edges include a front edge (e.g., the bottom of the drawing), a back edge (e.g., the top of the drawing), a first side edge (e.g., the left side of the drawing), and a second side edge (e.g., the right side of the drawing). In some embodiments, the netting body 302 is made of a 1" fiber mesh netting. Alternatively, other netting materials may be used.

In the exemplary embodiment as shown in FIGS. 3 and 4, the ball collection apparatus 110 further includes a plurality of connectors 304 attached to the netting body 302 at each of the four corners of the netting body 302. In some embodiments, each of the connectors 304 are configured to removably connect the main netting body 302 to wire portions of chain-link fencing of a sports cage (e.g., sports cage 100 of FIGS. 1 and 2).

In some embodiments, the connectors 304 are D-ring clips. For example, the connectors 304 may include stainless steel spring snap links (e.g., 7/16" to 1½" size). In the exemplary embodiment, the connectors are ¾" heavy duty D-ring clips. The spring snap link for the D-ring clips allows for easy install and uninstall. The stainless steel can be used to fight off rusting, especially for outdoor sports cages. Additionally, steel allows for more pressure and tension to be placed on the corners of the ball collection apparatus 110 when initially installing to help eliminate slack between corners as well as assist with making the sides with the fasteners 306 (e.g., hook and loop fasteners) easier to fasten. This can also help make the netting of the ball collection apparatus 110 flush with the netting of the sports cage.

In some embodiments, the connectors 304 are magnets that connect to a metal portion of the sports cage 100. In some embodiments, the connectors 304 are hook-and-loop fasteners. In some embodiments, the connectors 304 include for at least a portion of the connecting point, a snapping mechanism, such as a snap. In some embodiments, the connectors 304 include for at least a portion of the connecting point with the sports cage 100, an adhesive connection (e.g., an adhesive strip). Alternatively, other connecting devices may be used for the connectors 304 and the examples provided are not meant to be limiting to any particular type of connection device or mechanism.

In the exemplary embodiment as shown in FIGS. 3 and 4, the ball collection apparatus 110 further includes a plurality of fasteners 306 attached to the netting body 302. In some embodiments, the fasteners 306 are positioned between the corners along the back edge, the first side edge, and the second side edge of the netting body 302. In some embodiments, the fasteners 306 are configured to be adjustable. For example, the fasteners 306 may be hook-and-loop fasteners that can be quickly attached, unattached, and reattached, to provide a user installing the ball collection apparatus 110 to adjust the netting body 302 such that there are less gaps along the edges of the netting body 302. This ability for the fasteners 306 to be quickly attached and reattached allows the ball collection apparatus 110 to be quickly and efficiently installed so that sports balls are less likely to fall along those edges beneath the ball collection apparatus 110. In the exemplary embodiment, the fasteners 306 are 1" hook-and-loop fasteners, however, the specific size of the fasteners 306 can vary depending on the overall weight of the ball collection apparatus 110.

In the exemplary embodiment as shown in FIGS. 3 and 4, the ball collection apparatus 110 further includes a guiding device 114 operably coupled to the netting of the netting body 302 proximate an aperture defined by the netting. As shown in the side view of the ball collection apparatus 110 in FIG. 4, the guiding device 114 includes a weight (e.g., two pounds or greater) that is heavy enough to produce a slope in the netting 302 sufficient to guide a sport ball to exit the netting body 302 via the aperture. The guiding device 114 is further described herein with reference to FIG. 6.

Figure 5:
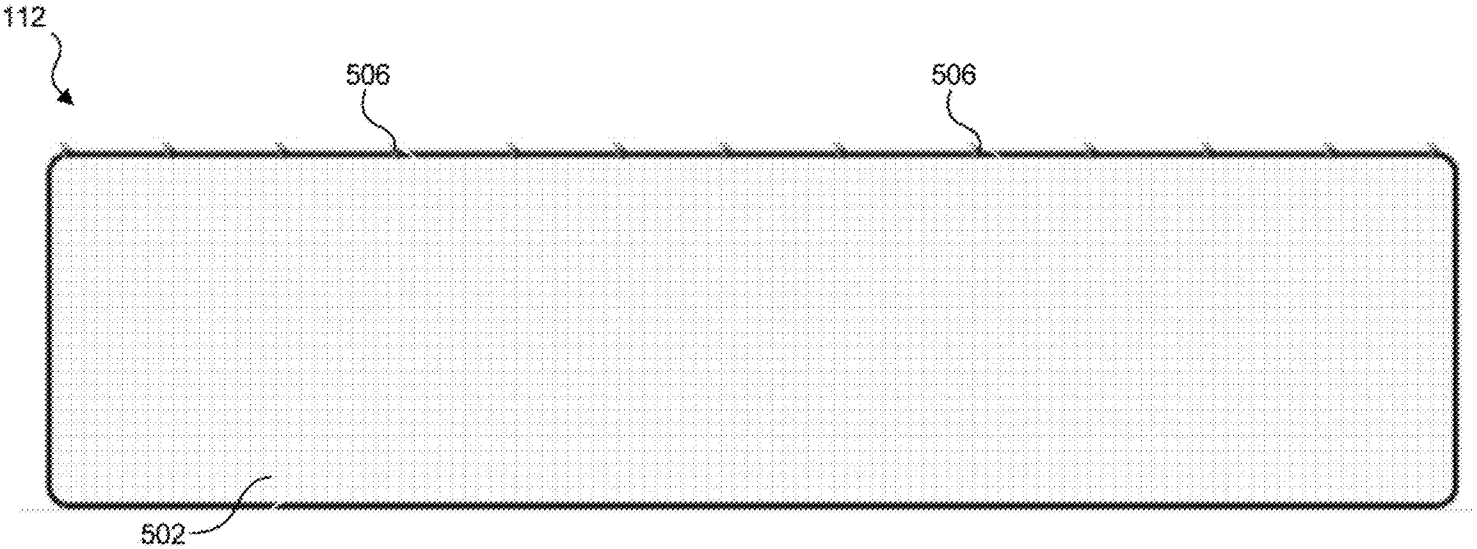
FIG. 5 is a drawing of an example attachment for an example ball collection apparatus.

FIG. 5 is a drawing of an example attachment for an example ball collection apparatus, a ground ball apparatus 112 (e.g., ground ball apparatus 112 of FIGS. 1 and 2). In some implementations, ground ball apparatus 112 includes a plurality of fasteners 506 at an edge of the ground ball apparatus 112. The fasteners 506 are constructed to connect a top edge of the ground ball apparatus 112 with the front edge of the netting body 302. In some embodiments, the fasteners 306 are configured to be adjustable. For example, the fasteners 506 may be hook-and-loop fasteners that can be quickly attached, unattached, and reattached, to provide a user installing the ground ball apparatus 112 with the ball collection apparatus 110 to adjust the netting the ground ball apparatus 112 such that there are less gaps along the edges of the netting body 302 so that sports balls are less likely to fall along those edges beneath the ball collection apparatus 110. In some embodiments, the ground ball apparatus 112 further includes connectors (e.g., similar to connectors 304 of ball collection apparatus 110) located at top corners of the ground ball apparatus 112. The connectors for the ground ball apparatus may include the similar connecting mechanism and/or material as the connectors 304 as described herein. In some embodiments, the netting of the ground ball apparatus 112 include materials that is similar to the netting body 302 of the ball collection apparatus 110 (e.g., a fiber net mesh).

Figure 6:
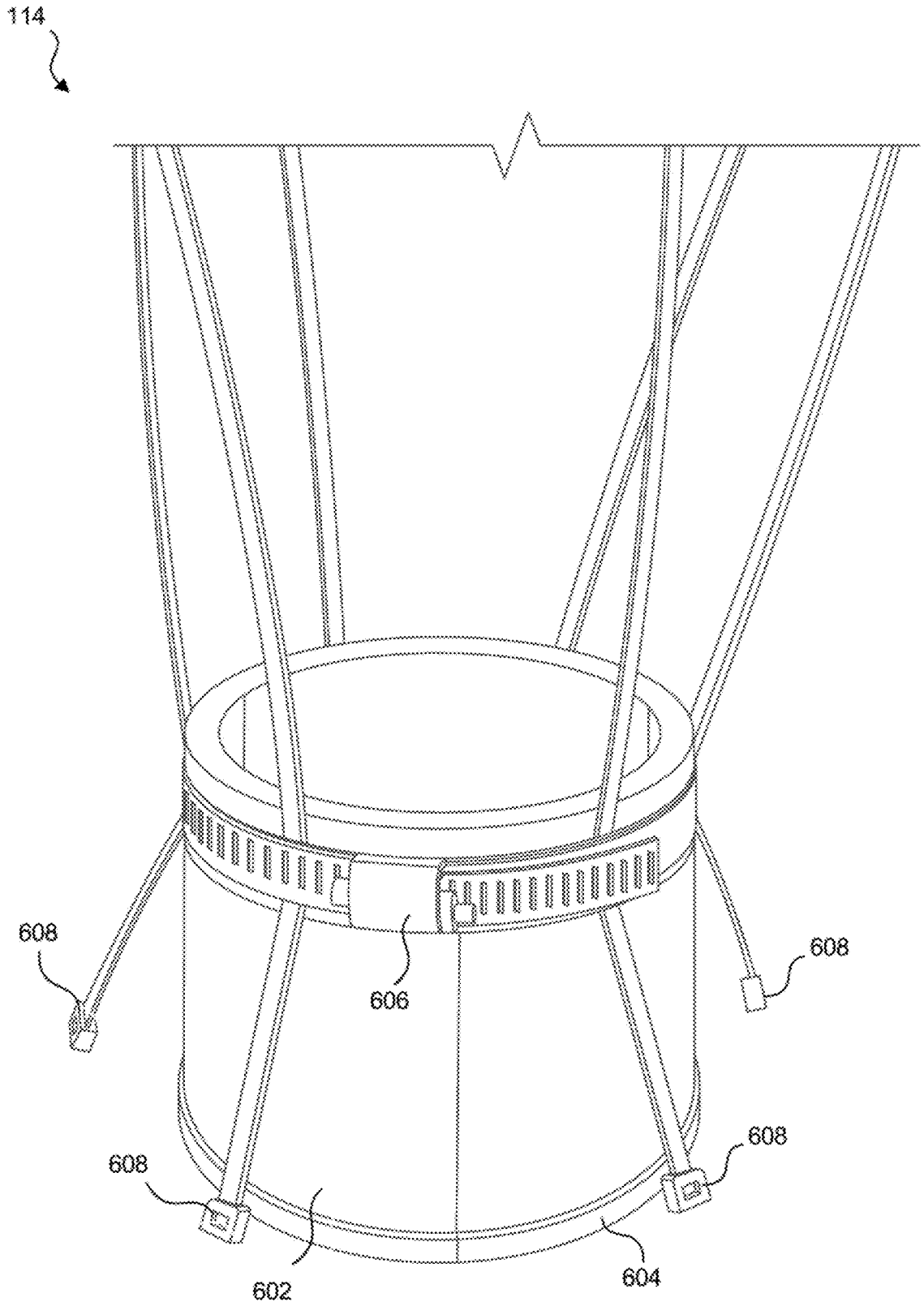
FIG. 6 is drawing of an example guiding device for an example ball collection apparatus.

FIG. 6 is drawing of an example guiding device 114 for an example ball collection apparatus (e.g., ball collection apparatus 110 as described herein). The guiding device 114 may be operably coupled to the netting body 302 proximate an aperture defined by the netting 302. The guiding device 114 may have a weight that produces a slope in the netting sufficient to guide a sports ball to exit the netting body 302 via the aperture. As shown in the side view of the ball collection apparatus 110 in FIG. 4, the guiding device 114 includes a weight (e.g., two pounds or greater) that is heavy enough to produce a slope in the netting 302 sufficient to guide a sport ball to exit the netting body 302 via the aperture. In some implementations, the guiding device 114 includes body 602 with a base 604. The body 602 is a cylindrical in shape, with an aperture large enough to allow a sports ball to passthrough (e.g., large enough for a softball to pass through, the largest typical ball to used in a sports cage as described). The guiding device 114 further includes a plurality of fasteners to attach to the netting body 302 of the ball collection apparatus 110. For example, fasteners 608 (e.g., zip ties or the like) can be used to secure the guiding device 114 to the netting body 302. The fastener 606 can be used to secure the fasteners 608 to the body 602 of the guiding device 114.

The guiding device 114 can be formed from a continuous piece of flexible material. For example, the guiding device 114 can be made of rubber material, such as latex, neoprene, nitrile, vinyl, polyvinyl chloride (PVC), and the like, or other strong and flexible material allowing appropriate durability for the use of the ball collection apparatus 110.

Figure 7:
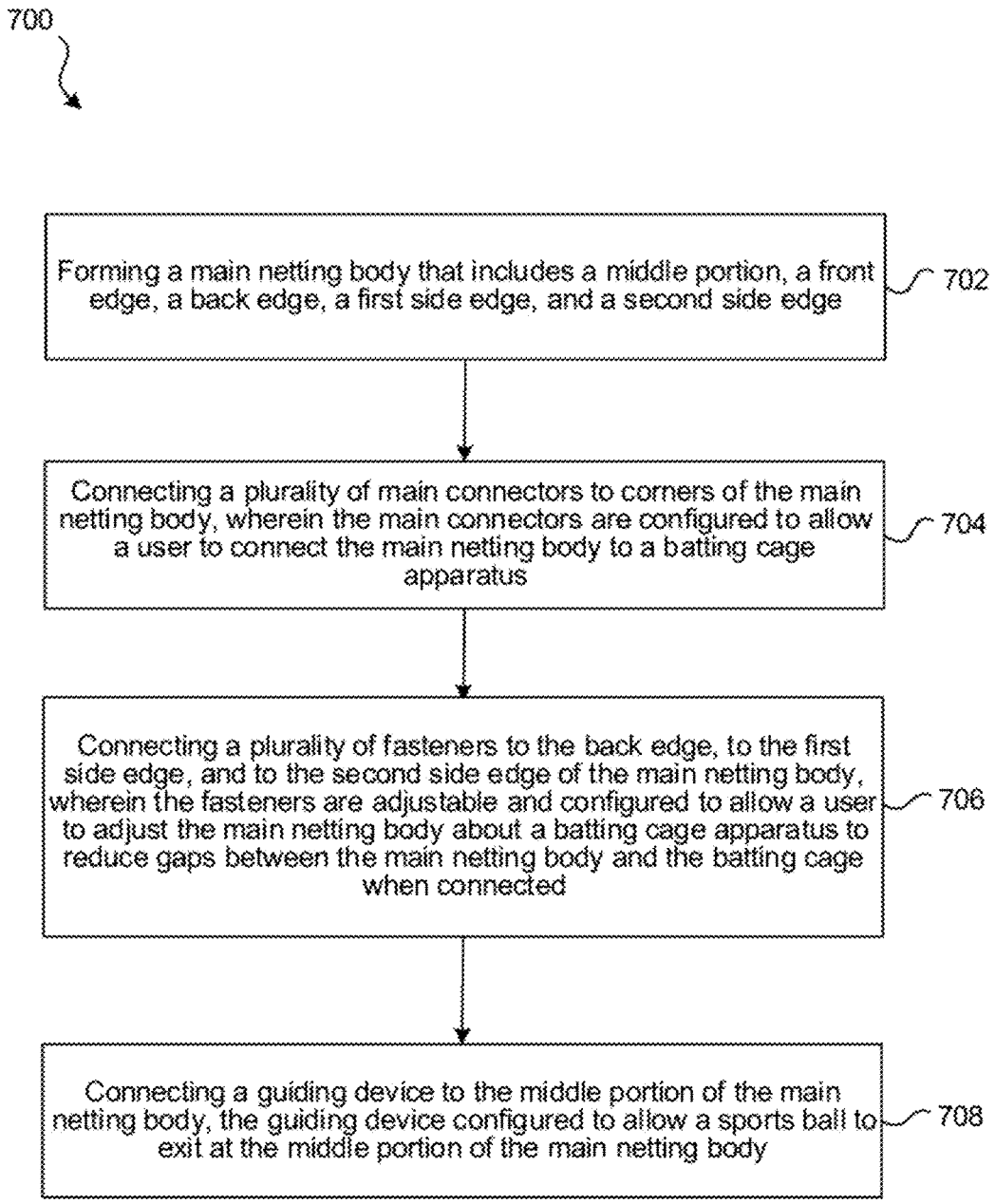
FIG. 7 is a flow chart of an example process for making a ball collection apparatus.

FIG. 7 is a flow chart of an example process 700 for making a ball collection apparatus (e.g., ball collection apparatus 110 as described herein). In some implementations, at block 702, the process 700 includes forming a main netting body that includes a middle portion, a front edge, a back edge, a first side edge, and a second side edge. The main netting body can be formed, for example, from a continuous piece of flexible netting material. For example, as latex, neoprene, nitrile, vinyl, PVC, leather, and the like, can be used to form the main netting body.

The main netting body can be formed, for example, to have netting, edges around a perimeter of the netting, and corners along the perimeter of the netting at intersections of the edges. The edges can include a front edge, a back edge, a first side edge, and a second side edge. In some implementations, the netting can include a fiber net mesh. Alternatively, the netting can include any type of netting that is space sufficiently that standard sport ball would not fall through the openings of the netting. For example, a golf ball sports cage may require smaller holes in the netting than a hitting cage for a baseball and/or softball (e.g., a golf ball is approximately 42 mm in diameter, and a baseball is approximately 75 mm in diameter). Thus, the holes in the netting need to be smaller than the size of the sports ball intended to be used in the sports cage.

At block 704, the process 700 includes connecting a plurality of main connectors to corners of the main netting body, wherein the main connectors are configured to allow a user to connect the main netting body to a batting cage apparatus. For example, the connectors are configured to removably connect the main netting body to wire portions of chain-link fencing of a sports cage (e.g., sports cage 100 of FIGS. 1 and 2). In some embodiments, the connectors are D-ring clips. In the exemplary embodiment, the connectors are ¾" heavy duty D-ring clips. In some embodiments, the connectors are magnets that connect to a metal portion of a sports cage. In some embodiments, the connectors are hook-and-loop fasteners. In some embodiments, the connectors include for at least a portion of the connecting point, a snapping mechanism, such as a snap. In some embodiments, the connectors include for at least a portion of the connecting point with a sports cage, an adhesive connection (e.g., an adhesive strip). Alternatively, other connecting devices may be used for the connectors and the examples provided are not meant to be limiting to any particular type of connection device or mechanism.

At block 706, the process 700 includes connecting a plurality of fasteners to the back edge, to the first side edge, and to the second side edge of the main netting body, wherein the fasteners are adjustable and configured to allow a user to adjust the main netting body about a batting cage apparatus to reduce gaps between the main netting body and the batting cage when connected. In some embodiments, the fasteners are configured to be positioned between the corners along the back edge, the first side edge, and the second side edge of the netting body. In some embodiments, the fasteners are configured to be adjustable. For example, the fasteners may be hook-and-loop fasteners that can be quickly attached, unattached, and reattached, to provide a user installing the ball collection apparatus to adjust the netting body such that there are less gaps along the edges of the netting body so that sports balls are less likely to fall along those edges beneath the ball collection apparatus.

At block 708, the process 700 includes connecting a guiding device to the middle portion of the main netting body, the guiding device configured to allow a sports ball to exit at the middle portion of the main netting body. In some implementations, the guiding device can be formed from a continuous piece of flexible material. For example, the guiding device can be made of rubber material, such as latex, neoprene, nitrile, vinyl, polyvinyl chloride (PVC), and the like, or other strong and flexible material allowing appropriate durability for the use of the ball collection apparatus.

In some implementations, the process 700 further includes connecting a ground ball apparatus to a first side of the main body of the ball collection apparatus using a plurality of connectors. In some implementations, the ground ball apparatus can be formed from a mesh netting, similar to the mesh netting used with the main netting body of the ball collection apparatus in block 702 (e.g., 1" fiber net mesh).

The terminology used herein is for the purpose of describing particular embodiments only and is not intended to be limiting of the embodiments of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Furthermore, to the extent that the terms "includes", "having", "has", "with", "comprised of", or variants thereof are used in either the detailed description or the claims, such terms are intended to be inclusive in a manner similar to the term "comprising".

While this specification contains many specific implementation details, these should not be construed as limitations on the scope of any features or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

While all of the invention has been illustrated by a description of various embodiments and while these embodiments have been described in considerable detail, it is not the intention of the Applicant to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of the Applicant's general inventive concept.

What is claimed is:

1. A ball collection apparatus for collecting balls in a sports cage, the ball collection apparatus comprising:

a netting body that comprises netting, edges around a perimeter of the netting, and corners along the perimeter of the netting at intersections of the edges, the edges comprising a front edge, a back edge, a first side edge, and a second side edge;

a plurality of connectors attached to the netting body at the corners of the netting body;

a plurality of fasteners attached to the netting body, wherein the fasteners are positioned between the corners along the back edge, the first side edge, and the second side edge of the netting body; and a guiding device operably coupled to the netting proximate an aperture defined by the netting, the guiding device having a weight to produce a slope in the netting sufficient to guide a sport ball to exit the netting body via the aperture.

2. The ball collection apparatus of claim 1, wherein, when the ball collection apparatus is connected to a sports cage via the plurality of connectors, the fasteners are attachable to the sports cage to reduce gaps between the netting body and the sports cage.

3. The ball collection apparatus of claim 1, wherein each of the fasteners comprises a hook-and-loop fastener.

4. The ball collection apparatus of claim 1, wherein the fasteners are equally-spaced along the back edge, the first side edge, and the second side edge of the netting body.

5. The ball collection apparatus of claim 1, wherein each of the connectors are configured to removably connect the main netting body to wire portions of chain-link fencing.

6. The ball collection apparatus of claim 1, wherein each of the connectors comprises a D-ring clip.

7. The ball collection apparatus of claim 1, wherein each of the connectors comprises magnets.

8. The ball collection apparatus of claim 1, wherein each of the connectors comprises a hook-and-loop fastener.

9. The ball collection apparatus of claim 1, wherein each of the connectors comprises at least a portion of a snap connector.

10. The ball collection apparatus of claim 1, wherein each of the connectors comprises an adhesive.

11. The ball collection apparatus of claim 1, wherein the netting comprises a fiber net mesh.

12. The ball collection apparatus of claim 1 further comprising a ground ball apparatus that includes a plurality of fasteners at an edge of the ground ball apparatus, the fasteners connecting a top edge of the ground ball apparatus with the front edge of the netting body.

13. The ball collection apparatus of claim 12, wherein the ground ball apparatus further comprises connectors located at top corners of the ground ball apparatus.

14. The ball collection apparatus of claim 12, wherein the ground ball apparatus comprises a netting.

15. A method of forming a ball collection apparatus, comprising:

forming a main netting body that includes a middle portion, a front edge, a back edge, a first side edge, and a second side edge;

connecting a plurality of main connectors to corners of the main netting body, wherein the main connectors are configured to allow a user to connect the main netting body to a batting cage apparatus;

connecting a plurality of fasteners to the back edge, to the first side edge, and to the second side edge of the main netting body, wherein the fasteners are adjustable and configured to allow a user to adjust the main netting body about a batting cage apparatus to reduce gaps between the main netting body and the batting cage when connected; and connecting a guiding device to the middle portion of the main netting body, the guiding device configured to allow a sports ball to exit at the middle portion of the main netting body.

16. The method of claim 15, further comprising:

connecting a ground ball net to a first side of the main body of the ball collection apparatus using a plurality of connectors.

* * * * *